United States Patent [19]

Simmons et al.

[11] Patent Number: 5,076,894

[45] Date of Patent: Dec. 31, 1991

[54] SUCTION BOX APPARATUS WITH COMPOSITE COVER ELEMENTS MOUNTED IN SLOTS ON CROSS BRACES

[76] Inventors: Holt W. Simmons, 570 SW. 139th, Beaverton, Oreg. 97006; Martin P. Franck, 2532 12th Ave., Forest Grove, Oreg. 97116; Danial L. Perry, 2265 SE. Bush St., Hillsboro, Oreg. 97123

[21] Appl. No.: 693,059

[22] Filed: Apr. 30, 1991

Related U.S. Application Data

[63] Continuation of Ser. No. 520,369.

[51] Int. Cl.[5] ..... D21F 1/52

[52] U.S. Cl. ..... 162/352; 162/374

[58] Field of Search ..... 162/352, 374, 363, 364, 162/354

[56] References Cited

U.S. PATENT DOCUMENTS

| | | | |
|---|---|---|---|
| 1,608,202 | 11/1926 | Compton | 162/374 |
| 1,657,509 | 1/1928 | Latham | 162/374 |
| 1,696,917 | 1/1929 | Lewis | 162/374 |
| 2,618,206 | 11/1952 | Van Ryzin | 162/374 |
| 2,740,332 | 4/1956 | Van Ryzin | 162/374 |
| 3,052,296 | 9/1962 | Justus | 162/354 |
| 3,194,729 | 7/1965 | Robinson | 162/374 |
| 3,337,394 | 8/1967 | White et al. | 162/352 |
| 3,393,124 | 7/1968 | Klinger et al. | 162/352 |
| 3,425,901 | 2/1969 | Koffskey Jr. | 162/352 |
| 3,708,390 | 1/1973 | Krake | 162/374 |
| 3,738,911 | 6/1973 | Kienzl et al. | 162/352 |
| 3,836,428 | 9/1974 | McConaughy | 162/274 |
| 3,928,125 | 12/1975 | Poeschl | 162/352 |
| 4,140,573 | 2/1979 | Johnson | 162/209 |
| 4,214,949 | 7/1980 | Schiel et al. | 162/352 |
| 4,265,706 | 5/1981 | Fulton | 162/352 |
| 4,319,957 | 3/1982 | Bartelmuss | 162/352 |
| 4,331,511 | 5/1982 | Goddard et al. | 162/352 |
| 4,334,958 | 6/1982 | Baluha et al. | 162/352 |
| 4,425,189 | 1/1984 | Mimura | 162/352 |
| 4,523,978 | 6/1985 | Pullinen | 162/352 |
| 4,789,433 | 12/1988 | Fuchs | 162/353 |
| 4,880,500 | 11/1989 | Eldridge et al. | 162/352 |

FOREIGN PATENT DOCUMENTS 350827 1/1990 European Pat. Off. .

*Primary Examiner*—Karen M. Hastings

*Attorney, Agent, or Firm*—Klarquist, Sparkman, Campbell, Leigh and Whinston

[57] ABSTRACT

Dewatering apparatus for papermaking machines, such as suction boxes, are provided with spaced cover elements of a composite structure. The cover elements include ceramic cover strips which engage the porous conveyor belt that conveys the paper web and are separated by drainage slots. The ceramic cover strips are bonded to support members of fiber-reinforced plastic. The cover elements are mounted on metal cross braces by mounting projections on the support members which slide into mounting slots of the same shape on the cross braces for attachment thereto without threaded fasteners or welding. The mounting slots and mounting projections may be of an interlocking shape, such as a dovetail shape or a T-shape, which prevents vertical movement of the cover elements toward or away from the conveyor belt while allowing horizontal sliding movement for insertion and removal of the cover elements into the mounting slots of the cross braces.

18 Claims, 3 Drawing Sheets

SUCTION BOX APPARATUS WITH COMPOSITE COVER ELEMENTS MOUNTED IN SLOTS ON CROSS BRACES

This application is a continuation of application Ser. No. 07/520,369, filed on May 4, 1990, now abandoned.

BACKGROUND OF THE INVENTION

The subject matter of the present invention relates generally to dewatering apparatus for papermaking machines and in particular to suction box apparatus, including a composite suction box cover having cover elements mounted in slots on cross braces. The cross braces which may be of metal extend across such cover elements and longitudinally of the porous conveyor belt conveying the paper web from which water is to be removed by the suction box or other dewatering apparatus. The composite suction box cover is preferably formed by cover strips of ceramic material bonded to fiber-reinforced plastic support members extending beneath such ceramic strips. The support members are provided with mounting projections which engage mounting slots in the cross braces for releasably mounting such cover strips on such cross braces without the use of threaded fasteners such as screws or bolts and without the need for welding or other time consuming and expensive fastening means.

The drainage apparatus of the present invention is especially useful in the manufacture of paper, pulp stock and nonwoven fabrics for the removal of water from the material being manufactured.

Previously it has been proposed in U.S. Pat. No. 4,140,573 of Johnson, issued Feb. 20, 1979, to provide a suction box apparatus, including a suction box cover formed by a plurality of cover elements or blades mounted on support rails of T-shaped cross section called "T-bars" which extend across the width of the conveyor belt on which the paper stock is transported. These T-bar support members are conventionally fastened to cross brace members by welding or by bolts or other mechanical fasteners which is extremely expensive and time consuming process. In addition, in the case of threaded mechanical fasteners, there is a continued maintenance problem because such fasteners can loosen and fall into the papermaking machinery and onto the conveyor belt, "wire" or fabric, thereby damaging the machinery or conveyor belt. When the T-bar support members are welded to the cross braces, this overcomes the problem of loosening bolts and damage to the papermaking machine but the fastening is extremely expensive and time-consuming. The suction box cover apparatus of the present invention avoids the need for welding or threaded fasteners by using metal cross braces which are slotted with mounting slots to engage mounting projections on the bottom of support members of fiber-reinforced plastic material to which the cover strips of ceramic material are bonded. This overcomes the above-mentioned problems and has the added advantage that allows the cover elements to be easily inserted and removed in the case of damage or replacement of the cover elements for other reasons. The cross braces are made in a simple and inexpensive manner by machining metal bar stock rather than requiring the bracing to be made by casting, and thereby allows a greater flexibility in the design of the suction box cover to accommodate changes in the width of the cover elements and the drainage slot spacing between elements which varies, depending upon many factors, including the position of the suction box in the papermaking machine and the vacuum pressure within such suction box.

In U.S. Pat. No. 4,334,958 of Baluha et al issued June 15, 1982, it has been previously proposed to provide a suction box cover element or a dewatering foil, including a wear insert of ceramic material bonded to a fiber reinforced plastic base support member to provide a cover element which is secured by a dovetail tongue and groove connection on the bottom of the support member to a lower section or intermediate support member of plastic material which is mounted on a T-bar bracket attached by bolts to the top of a frame member. However, this extremely complicated device differs from that of the present invention in that it employs bolts to fasten the T-bar brackets which can loosen and fall out to damage the conveyor wire and does not provide slotted cross braces having mounting slots in which the cover elements are secured by mounting projections on the bottom of such cover elements.

Suction box covers have previously been provided with metal cross braces as shown in U.S. Pat. No. 1,657,509 of Latham, issued Jan. 31, 1928, and U.S. Pat. No. 1,696,917 of Lewis, issued Jan. 1, 1929, which show cover elements of wood attached to metal bars supported on cross braces or bridge members. Also, U.S. Pat. No. 3,708,390 of Krake, issued Jan. 2, 1973, discloses a felt dewatering apparatus, including a suction box employing plastic cover elements attached to J-shaped metal supports supported on a metal plate. However, metal cross braces have not been employed to mount suction box cover elements directly thereon by means of mounting slots provided in such cross braces in the manner of the present invention.

While the preferred embodiments of the present invention are hereafter described with respect to a suction box cover, the present invention applies to other types of drainage apparatus used in papermaking machines, including dewatering devices which engage the felt conveyor belt in the press section of such machines as well as foil type water removal devices in the sheet forming section which produce a vacuum pressure by the foil action of the conveyor belt as it passes over the contacting leading edge and the diverging trailing edge of such foils and thus do not require an external source of vacuum pressure in the manner of suction boxes. In addition, it should be noted that the drainage box covers can have their conveyor contacting surface either flat or of a convexly curved shape. Also, the cover strips of ceramic material can be of varying widths and spacing between adjacent cover strips to provide drainage slots can be of varying widths.

SUMMARY OF THE INVENTION

It is therefore one object of the present invention to provide an improved drainage apparatus for a papermaking machine of simple and economical construction which employs slotted cross braces for mounting drainage cover elements in mounting slots thereon.

Another object of the invention is to provide such a drainage apparatus, including drainage box cover elements which are composite structures formed by cover strips of ceramic material attached to support members of fiber reinforced plastic material provided with mounting projections on the bottom thereof for insertion in the mounting slots provided on the cross braces in order to provide a drainage box cover which is light-weight and of great strength so it can span a wider paper sheet and operate at a higher vacuum pressure while also being highly wear resistant.

A further object of the invention is to provide an improved suction box apparatus for a papermaking machine of simple and inexpensive construction, employing slotted cross braces with mounting slots therein for mounting the suction box cover elements thereon without employing bolts, screws or other mechanical fasteners or welding, thereby reducing the danger of damage to the porous conveyor belt by falling fasteners, which is less costly to manufacture and is a more versatile apparatus whose cover elements and drainage slots can be changed in width to accommodate different dewatering conditions.

An additional object of the invention is to provide such an improved suction box cover of composite construction in which the cover elements are formed by cover strips of ceramic material which are bonded to support members of fiber reinforced plastic material having mounting projections thereon for engagement with mounting slots in cross braces to provide a cover which is of light weight and great strength and is more easily installed by sliding the cover elements into such slots without stopping the papermaking machine or removing the conveyor belt.

Still another object of the present invention is to provide such a suction box apparatus in which the slotted cross braces are provided with mounting slots of dovetail or T shape that hold the cover elements in a fixed position to prevent vertical movement toward or away from the conveyor belt but which allow sliding movement horizontally for insertion and removal of the cover elements in the mounting slots.

A still further object of the present invention is to provide such a suction box apparatus in which the cross braces are provided with tapered top portions facing the conveyor belt to improve the water flow during dewatering.

DESCRIPTION OF THE DRAWINGS

Other objects and advantages of the present invention will be apparent from the following detailed description of certain preferred embodiments thereof and from the attached drawings of which.

DESCRIPTION OF THE PREFERRED EMBODIMENTS

Figure 1:
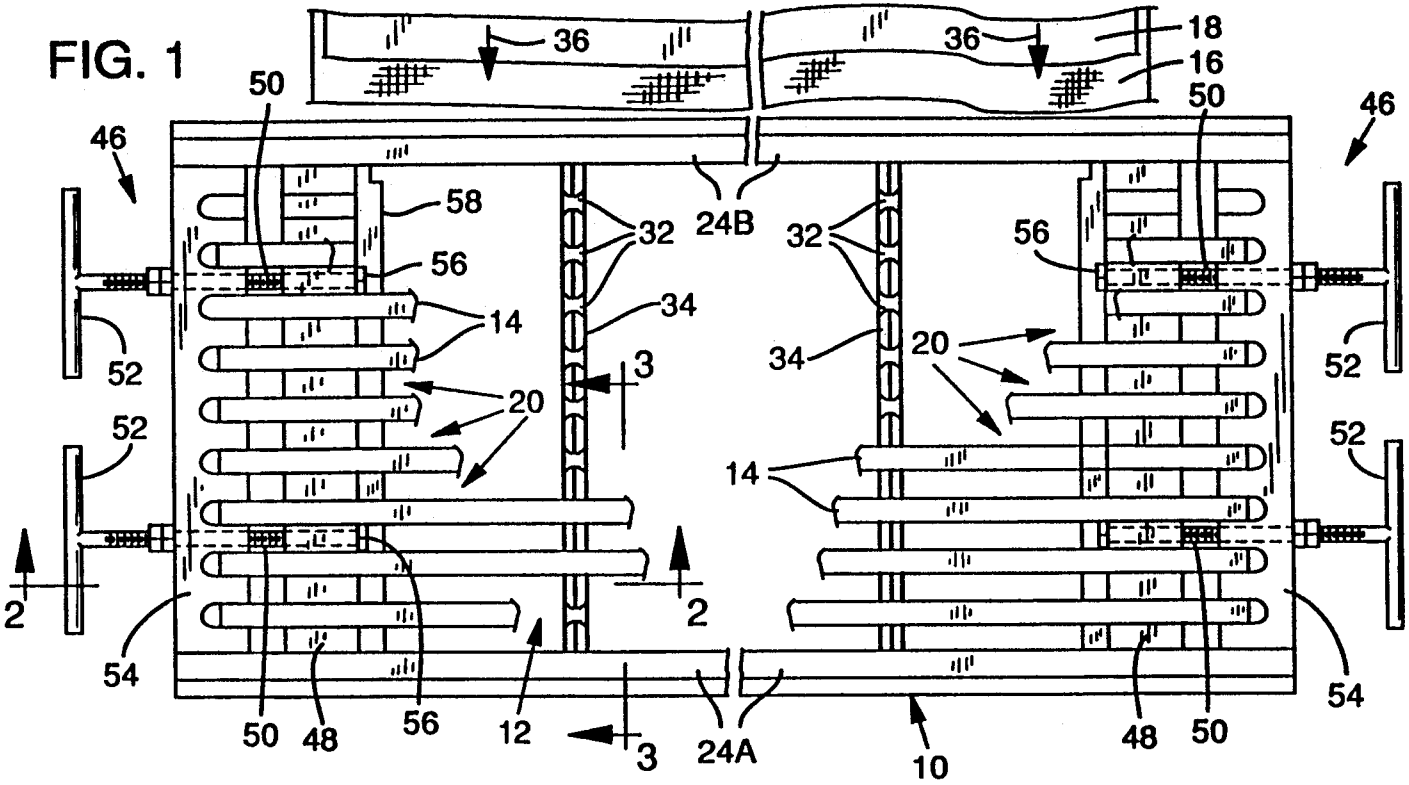
FIG. 1 is a plan view of a suction box apparatus made in accordance with one embodiment of the present invention.

As shown in FIGS. 1–4, one embodiment of the drainage apparatus of the present invention is a suction box apparatus 10, including a suction box connected to an external source of vacuum pressure (not shown) in a conventional manner and a suction box cover 12. The suction box cover is formed by spaced cover elements 14 which may be composite structures extending across the width of a porous conveyor belt 16. The conveyor belt may be metal wire or woven plastic fabric and is motor driven at high speed up to 3,500 feet per minute to convey a paper web 18 across such suction box cover for removing water from such paper web. The suction box cover elements 14 are spaced apart by drainage slots 20 which extend across the width of the conveyor belt 16 to allow water which is drawn from the paper web 18 through the conveyor belt 16 by the vacuum pressure within the suction box to drain through slots 20 into the suction box. The suction box has an external vacuum pressure source connected thereto, which reduces the pressure within the suction box below atmospheric pressure to a pressure of, for example, about 10 to 20 inches of mercury pressure.

Figure 3:
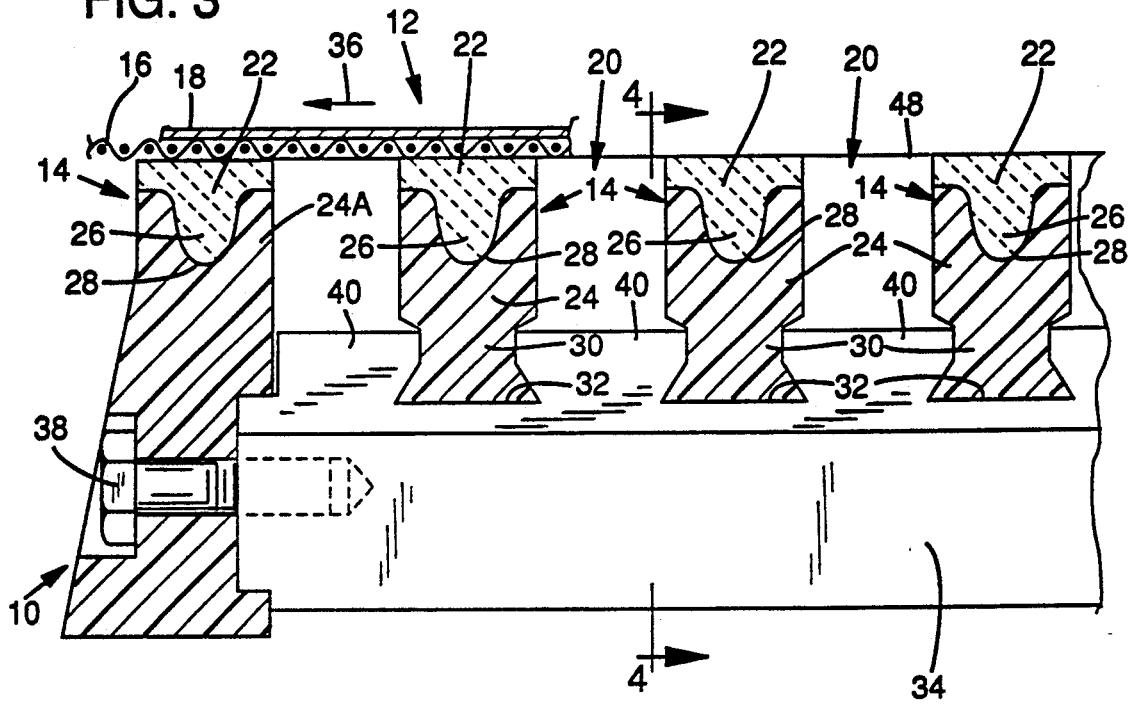
FIG. 3 is an enlarged vertical section view taken along the line 3—3 of FIG. 1 showing the suction box cover elements mounted in dovetail slots on the cross braces for engagement with dovetail projections on the bottom of the support members to which the ceramic cover strips are attached.
Figure 4:
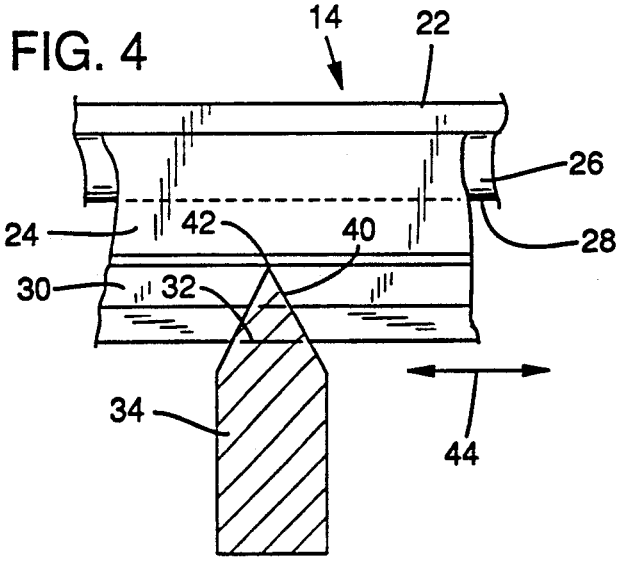
FIG. 4 is a vertical section view taken along the line 4—4 of FIG. 3.

As shown in FIGS. 3 and 4, the suction box cover elements 14 may be composite structures formed by cover strips 22 of ceramic material such as aluminum oxide or zirconium oxide ceramic, which extend across the full width of the paper web 18 and whose upper surface contacts conveyor belt 16. The ceramic cover strips 22 are fixed to support members 24 of fiber reinforced plastic material such as fiberglass-reinforced polyester. The ceramic cover strips 22 are each formed of a plurality of segments mounted end to end and provided with a tongue portion 26 which extends downwardly away from the conveyor belt 16 into a mating groove 28 in the top of the support member 24. Adhesive bonding material such as epoxy resin is provided at the interface between the tongue projection 26 and the groove 28 in order to bond the ceramic strips 22 to the fiberglass-reinforced plastic support members 24. The central support members 24 between the two outer support members 24A and 24B are each provided with a mounting projection 30 on the bottom thereof which is of a configuration to mate with mounting slots 32 provided in metal cross braces 34. The cross braces extend across the suction box cover 12 in a direction longitudinally of the conveyor belt 16 which in FIG. 3 moves in a direction right to left indicated by arrow 36.

In the preferred embodiment of FIGS. 1–4, the mounting slots 32 in the cross braces 34 have a dovetail shape and mate with dovetail projections 30 at the bottom of the supporting members 24. It should be noted that a plurality of spaced cross braces 34 are provided beneath the cover elements 14, each of such cross braces being provided with a number of mounting slots 32 which correspond to the number of cover elements 14. The opposite ends of the cross braces 34 are fastened to the outer support members 24A and 24B of the suction box cover, respectively positioned at the trailing and leading ends of the suction box by means of bolts 38 as shown in FIG. 3. However, it should be noted that there are no other bolts provided for fastening the cross braces 34 to the central mounting members 24 for the suction box cover elements 14. The bolts 38 are screwed into threaded holes in the opposite ends of each of the metal cross braces 34 to attach such cross braces so that they each extend across all of the suction box cover elements 14 to support such elements in mounting slots 32 and extend longitudinally of the conveyor belt 16 as shown in FIG. 1.

The cross braces 34 are made of stainless steel or other noncorrosive metal and are provided with tapered top portions 40 between each of the mounting slots 32. The tapered top portion 40 tapers from a maximum width at a mid-portion of the cross brace to a pointed ridge 42 at the top of such cross brace, as shown in FIG. 4. This tapered top portion increases the water drainage efficiency through such cross braces for water which is removed from the paper web 18 and passes through the porous conveyor belt 16 into the suction box as a result of the vacuum pressure within the suction box. In one preferred embodiment, the slope of the sides of the top portion 40 are approximately 30° with respect to the vertical projection of the sides of such cross brace. As shown in FIG. 4, the suction box cover elements 14 are inserted into and removed from the mounting slots 32 in the cross brace 34 by horizontal sliding movement in the direction of arrow 44 to enable installation or removal of a cover element without the need to remove the conveyor belt from the papermaking machine which would otherwise require stopping the machine. This enables replacement of damaged or worn cover elements or the replacement of cover elements of different size in a simple and inexpensive manner without the need to shut down the papermaking machine.

Figure 2:
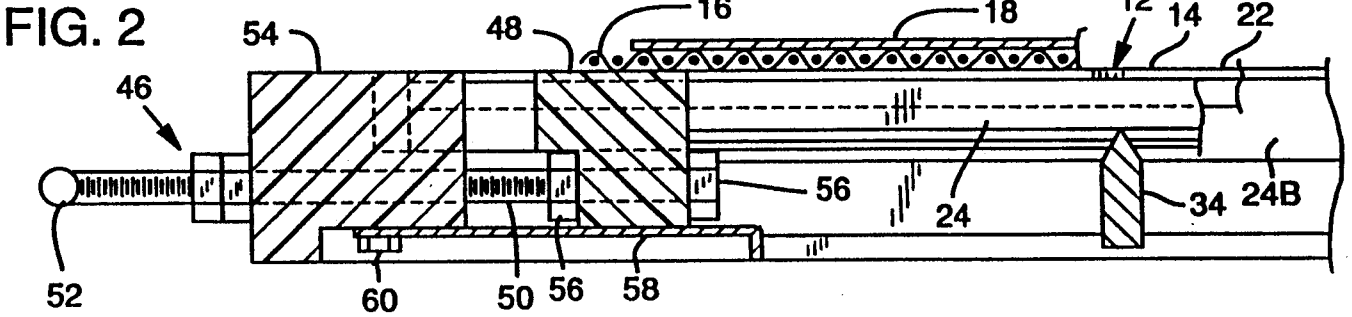
FIG. 2 is an enlarged horizontal section view taken along the line 2—2 of FIG. 1.

As shown in FIG. 2, an adjustable deckle device 46 may be provided on the opposite sides of the suction box cover 12 to allow paper webs of different width to be formed thereon. The deckle device includes a deckle seal member 48 of a suitable sealing material such as polyethylene plastic which is notched to fit between the suction box cover elements 14 in order to fill the drainage slots and seal the space between such elements at the end of such slots to provide a vacuum seal with the opposite edges of the paper web 18 as they pass over such deckle members. The deckle members 48 are adjusted in position laterally across the conveyor belt 16 to accommodate paper webs of different width by means of adjustment screws 50 having handles 52 attached to the outer ends of the screw shafts. The adjustment screw shafts pass through drilled passages in two plastic laminate end members 54 and are secured to the deckle seal member 48 by locknuts 56 on the opposite sides of such seal members, as shown in FIG. 2. Thus, rotation of the handles 52 causes rotation of the adjustment screw shafts 50 which slides the deckle seal members 48 toward and away from the end member 54 in order to adjust the lateral position of the deckle members. The deckle member 48 slides across a support plate 58 of metal which is fastened by bolts 60 to the bottom of the end member 54 and forms a vacuum seal with such support plate to prevent pressure leaks between the deckle member 48 and the end member 54.

In one example of the present invention having a suction box cover with an overall length across the conveyor belt of about 280", twenty-nine of the cross braces 34, each 1.5"high, 0.5"wide and 13.5"long, were provided, equally spaced 8" apart, with the space between the two deckle members 48 varying between about 241" and 246". In this example, the ceramic cover strips 22 were about 0.625" wide, 0.437" high and 251.63" long while the drainage slots 20 between such strips were approximately 0.750" wide. Eleven of the suction box cover elements 14 were employed in this cover so that the width of the suction box from the front end support member 24B to the rear end support member 24A was about 14.625" at the top of the suction box, such end support members being clamped to the body of the suction box in a conventional manner by means of mechanical clamps not shown. However, it should be noted that the width of the suction box cover elements and the drainage slot spacing between such elements can vary, depending upon the position of the suction box within the papermaking machine and the operating conditions.

Figure 5:
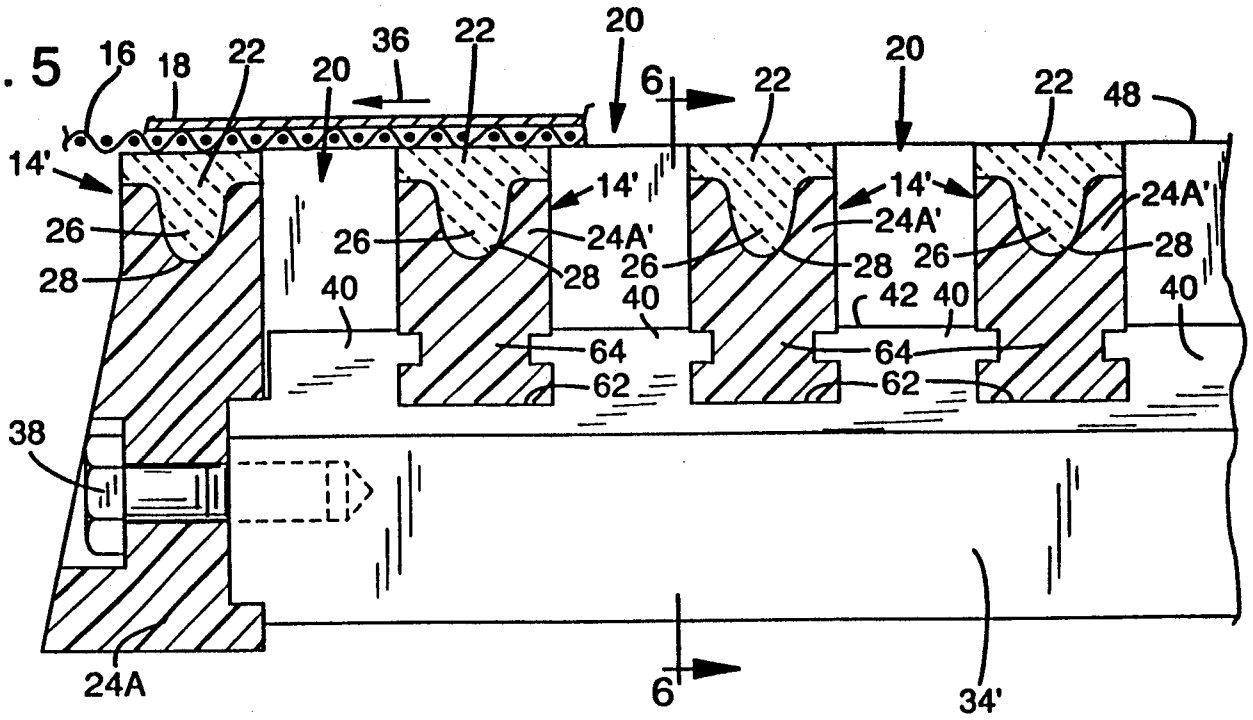
FIG. 5 is a section view similar to FIG. 3 but showing a second embodiment of the suction box cover of the present invention in which the cross braces are provided with T-shaped slots for engagement with T-shaped mounting projections on the bottom of the support members supporting the ceramic cover strips.
Figure 6:
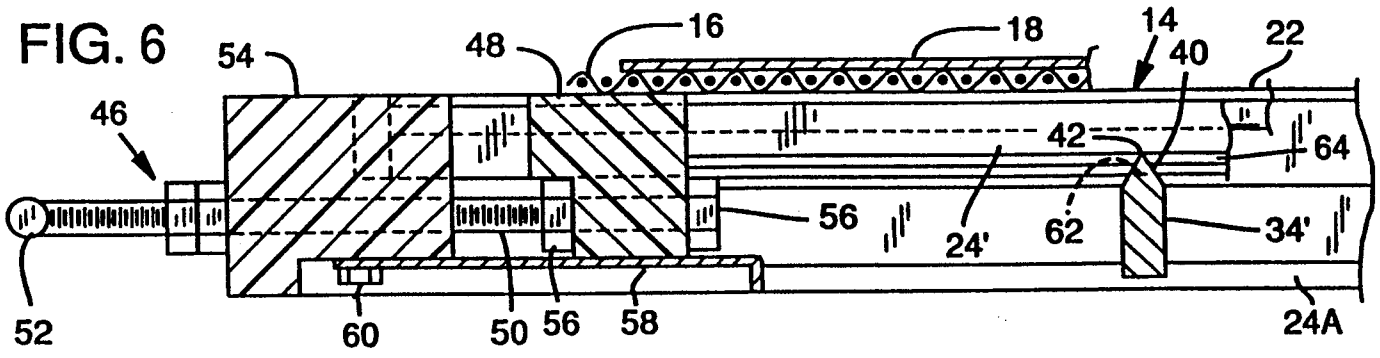
FIG. 6 is an enlarged vertical section view taken along the line 6—6 of FIG. 5.

A second embodiment of the suction box apparatus of the present invention is shown in FIGS. 5 and 6 which is similar to the embodiment of FIGS. 1 and 4 so that the same reference numbers are used to designate similar parts and only the differences will be described and shown. In this embodiment, T-shaped mounting slots 62 are provided in the cross braces 34 which are of an inverted T-shaped cross section. A mounting projection 64 of a corresponding T-shaped cross section is provided on the bottom of each of the support members 24' which are bonded to the ceramic cover strips 22 forming the cover elements 14'. Thus, the embodiment of FIGS. 5 and 6 differs only in the shape of the mounting slots 62 in the cross braces 34 and the shape of the mounting projections 64 on the bottom of the support members 24 for the ceramic strips 22. However, it should be noted that other changes may be made, such as by providing a low profile suction box cover element in which the U-shaped tongue and groove attachment 26, 28 of the ceramic members 22 and the support members 24 may be changed in shape such as to a T-shaped tongue and groove attachment of reduced height compared to the cover elements from the high profile shown. Thus, in the above example, the high profile cover elements are approximately 1.04" high, while the low profile cover elements are 0.625" height. However, the principle of operation of the invention is the same.

It will be obvious to those having ordinary skill in the art that many changes may be made in the above-described preferred embodiments of the present invention without departing from the spirit of the invention. Therefore, the scope of the present invention sought to be protected should be determined by the following claims.

We claim:

1. Suction box apparatus for a papermaking machine, comprising:

suction box means for removing water from a web conveyed across said suction box means by a porous conveyor belt when said suction box means is mounted in a papermaking machine, including a suction box having a length extending across the conveyor belt and a width extending along the conveyor belt;

a suction box cover, including a plurality of cover strips of ceramic material extending along the length of the suction box and supported on a top portion of the suction box in spaced relationship to be located at positions spaced along the width of the suction box so that said conveyor belt engages the ceramic cover strips and said cover strips are separated by drainage slots;

support means for supporting the ceramic cover strips, including support members of plastic material attached to the cover strips by bonded tongue and groove attachment means and extending along the length of the suction box, and including spaced cross braces of metal which extend across the support members at positions spaced along the length of the suction box; and releasable interlocking connection means for connecting the support members to the cross braces with releasable interlocking connections, including mounting slots in such cross braces which slidably engage mounting projections on the support members for releasable interlocking connection thereof which enable removal of the cover strips from the suction box by sliding said support members longitudinally in said mounting slots relative to said cross braces, said interlocking connections preventing movement of the support members within said mounting slots toward or away from the top portion of said suction box.

2. Suction box apparatus in accordance with claim 1 in which the support members are of fiber-reinforced plastic material.

3. Suction box apparatus in accordance with claim 1 in which the support members contain fiberglass.

4. Suction box apparatus in accordance with claim 1 in which the mounting slots and projections are of a dovetail shape.

5. Suction box apparatus in accordance with claim 1 in which the mounting slots and projections are of a T-shape.

6. Suction box apparatus in accordance with claim 1 in which the cross braces have intermediate portions between the mounting slots which taper toward ridges at their outer edges extending toward the conveyor belt.

7. Suction box apparatus in accordance with claim 1 in which the ceramic cover strips include tongue portions which extend into grooves in the support members and are bonded thereto to provide the tongue and groove attachment.

8. Suction box apparatus in accordance with claim 7 in which the bonding is provided by adhesive bonding material in said grooves.

9. Suction box apparatus in accordance with claim 1 in which the metal cross braces are attached to front and rear supports extending laterally across the conveyor by threaded fasteners.

10. Suction box apparatus in accordance with claim 9 in which the front and rear supports are plastic support members for front and rear ceramic cover strips at the front and rear edges of the suction box.

11. In a papermaking machine, drainage apparatus comprising:

drainage means for removing water from a paper web conveyed across said drainage means by a porous conveyor belt and including a drainage box having a length extending across the conveyor belt and a width extending along the conveyor belt;

said drainage means including a plurality of cover strips of ceramic material extending across the length of the drainage box and supported on a top portion of the drainage box in spaced relationship at positions spaced across the width of the drainage box so that said conveyor belt engages the ceramic cover strips and said cover strips are separated by drainage slots;

support means for supporting the ceramic cover strips, including support members attached to the cover strips by bonded tongue and groove attachment means and extending along the length of the drainage box, and including spaced cross braces which extend across the support members at positions spaced along the length of the drainage box; and releasable connection means for connecting the support members to the cross braces with releasable interlocking connections, including mounting slots which slidably engage mounting projections for releasable interlocking connection thereof which enable removal of the cover strips from the drainage apparatus by sliding said support members longitudinally in said mounting slots relative to said cross braces, said interlocking connections preventing movement of the support members within said mounting slots toward or away from the top portion of said drainage box.

12. Drainage apparatus in accordance with claim 11 in which the support members are of fiber-reinforced plastic material.

13. Drainage apparatus in accordance with claim 11 in which the mounting slots and projections are of a dovetail shape.

14. Drainage apparatus in accordance with claim 11 in which the mounting slots and projections are of a T-shape.

15. Drainage apparatus in accordance with claim 11 in which the cross braces have intermediate portions between the mounting slots which taper toward ridges at their outer edges extending toward the conveyor belt.

16. Drainage apparatus in accordance with claim 11 in which the ceramic cover strips include tongue portions which extend into grooves in the support members and are bonded thereto to provide the tongue and groove attachment.

17. Drainage apparatus in accordance with claim 11 in which the cross braces are attached to front and rear supports extending laterally across the conveyor by threaded fasteners.

18. Drainage apparatus in accordance with claim 17 in which the front and rear supports are fiberglass reinforced plastic support members for front and rear ceramic cover strips at the front and rear edges of a suction box.

* * * * *